US008009998B2

(12) United States Patent
Kajita

(10) Patent No.: US 8,009,998 B2
(45) Date of Patent: Aug. 30, 2011

(54) FIXING DEVICE

(75) Inventor: Masahito Kajita, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 373 days.

(21) Appl. No.: 12/407,189

(22) Filed: Mar. 19, 2009

(65) Prior Publication Data

US 2009/0297180 A1 Dec. 3, 2009

(30) Foreign Application Priority Data

May 29, 2008 (JP) ..... 2008-140597

(51) Int. Cl.
*G03G 15/20* (2006.01)

(52) U.S. Cl. ..... 399/33; 399/328

(58) Field of Classification Search ..... 399/9, 33, 399/67, 69, 122, 320, 328–334; 219/216, 219/619

See application file for complete search history.

(56) References Cited

U.S. PATENT DOCUMENTS 5,017,970 A 5/1991 Sakata
5,737,664 A * 4/1998 Fukuda et al. ..... 399/33
6,415,113 B2 * 7/2002 Kiuchi ..... 399/33
7,369,801 B2 * 5/2008 Tsueda et al. ..... 399/328
7,693,435 B2 * 4/2010 Moriguchi et al. ..... 399/33

FOREIGN PATENT DOCUMENTS

JP 64-009484 1/1989
JP 05-088584 4/1993
JP 06-124050 5/1994
JP 10-326054 12/1998

* cited by examiner

*Primary Examiner* — Hoan Tran

(74) *Attorney, Agent, or Firm* — Banner & Witcoff, Ltd.

(57) ABSTRACT

A fixing device including a heating element and a pressure element, for fixing a developer image transferred onto a recording sheet is provided. The pressure element is configured to be positioned selectively in two or more pressing positions defined relative to the heating element. The pressure element in any one of the pressing positions is configured to be pressed against the heating element. A plurality of interrupter elements are provided opposite to the heating element. Each of the interrupter elements is configured to sense a temperature of the heating element and to interrupt a flow of electrical current to a heat source for heating the heating element when the temperature is not lower than a predetermined threshold value. The interrupter elements are arranged in positions corresponding to the pressing positions.

9 Claims, 8 Drawing Sheets

FIXING DEVICE

CROSS-REFERENCE TO RELATED APPLICATION(S)

This application claims the foreign priority benefit under Title 35, United States Code, §119 (a)-(d), of Japanese Patent Application No. 2008-140597, filed on May 29, 2008 in the Japan Patent Office, the disclosure of which is herein incorporated by reference in its entirety.

BACKGROUND OF THE INVENTION

1. Field of the Invention

The present invention relates to a fixing device for thermally fixing a developer image transferred onto a recording sheet.

2. Description of Related Art

In a fixing device provided in an image-forming apparatus, it is generally known that a sheet of paper (or recording sheet) tends to curve along the peripheral surface of a heating roller or a pressure roller, which phenomenon is sometimes called "curl" of the sheet. The curl of the sheet would result in a sheet jam or a disturbed order of sheets ejected onto a sheet output tray. With this in view, a fixing device of a particular type has been proposed (for example, see patent document 1 listed below), in which a pressure roller is configured to be movable relative to a heating roller so that the position of the pressure roller is adjusted relative to the heating roller in accordance with the sheet curling condition to thereby correct the curl of a sheet.

The fixing device has an interrupter element such as a thermostat or a thermal fuse provided across the heating roller from the pressure roller, the interrupter element being configured to sense a surface temperature of the heating roller so as to interrupt the flow of electrical current to a heat source of the heating roller when the temperature is not lower than a predetermined threshold value. When the surface temperature of the heating roller increases beyond a fixing temperature and a plastic bushing for the heating roller is molten, the heating roller pressed by the pressure roller comes closer to the interrupter element. In this way, the temperature sensed at the interrupter element becomes the predetermined threshold value or higher more swiftly, and thus the flow of electrical current to the heat source is swiftly interrupted so that the increase in the temperature of the heating roller can be swiftly stopped. See patent document 2 listed below, for example.

PATENT DOCUMENTS

1. JP 64-009484 A
2. JP 6-124050 A

In the aforementioned configuration of patent document 1 with the pressure roller changeable in position, the change in the position of the pressure roller changes the direction in which the pressure roller presses the heating roller, and thus the time required to interrupt the flow of electrical current to the heat source varies accordingly. To be more specific, when the bushing for the heating roller is molten and the heating roller is pushed by the pressure roller toward the interrupter element, the position of the thus-moved heating roller relative to the interrupter element varies depending upon the position of the pressure roller, and thus the time required for the temperature sensed at the interrupter element to become the predetermined threshold value or higher varies, so that the time required to interrupt the flow of electrical current to the heat source also varies.

It would be desirable to provide a fixing device having a pressure element changeable in position relative to a heating element, wherein the flow of electrical current to a heat source can be interrupted under the same conditions which do not vary according to the positions of a pressure element.

SUMMARY OF THE INVENTION

In one aspect of the present invention, a fixing device for fixing a developer image transferred onto a recording sheet is provided. The fixing device comprises a heating element, a pressure element and a plurality of interrupter elements. The heating element is configured to be heated by a heat source. The pressure element is configured to be positioned selectively in two or more pressing positions defined relative to the heating element, and the pressure element in any one of the pressing positions is configured to be pressed against the heating element. The plurality of interrupter elements are provided opposite to the heating element, and each configured to sense a temperature of the heating element and to interrupt a flow of electrical current to the heat source when the temperature is not lower than a predetermined threshold value. The interrupter elements are arranged in positions corresponding to the pressing positions. It is to be understood that the number of the interrupter elements is not necessarily equal to the number of the pressing positions; i.e., one interrupter element may be in a position corresponding to two pressing positions.

With the fixing device configured as described above, since at least one of the interrupter elements is provided in a position corresponding to each of the pressing positions, the temperature of the heating element, irrespective of which pressing position the heating element is located in, can be sensed under fixed conditions by a corresponding interrupter element. Thus, the flow of electrical current to a heat source can be interrupted under the same conditions which do not vary according to the position of a pressure element.

In this way, it is one aspect of the present invention to provide a fixing device having a pressure element changeable in position relative to a heating element, wherein the flow of electrical current to a heat source can be interrupted under the same conditions which do not vary according to the position of a pressure element.

BRIEF DESCRIPTION OF THE DRAWINGS

The above aspects, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

Figure 1:
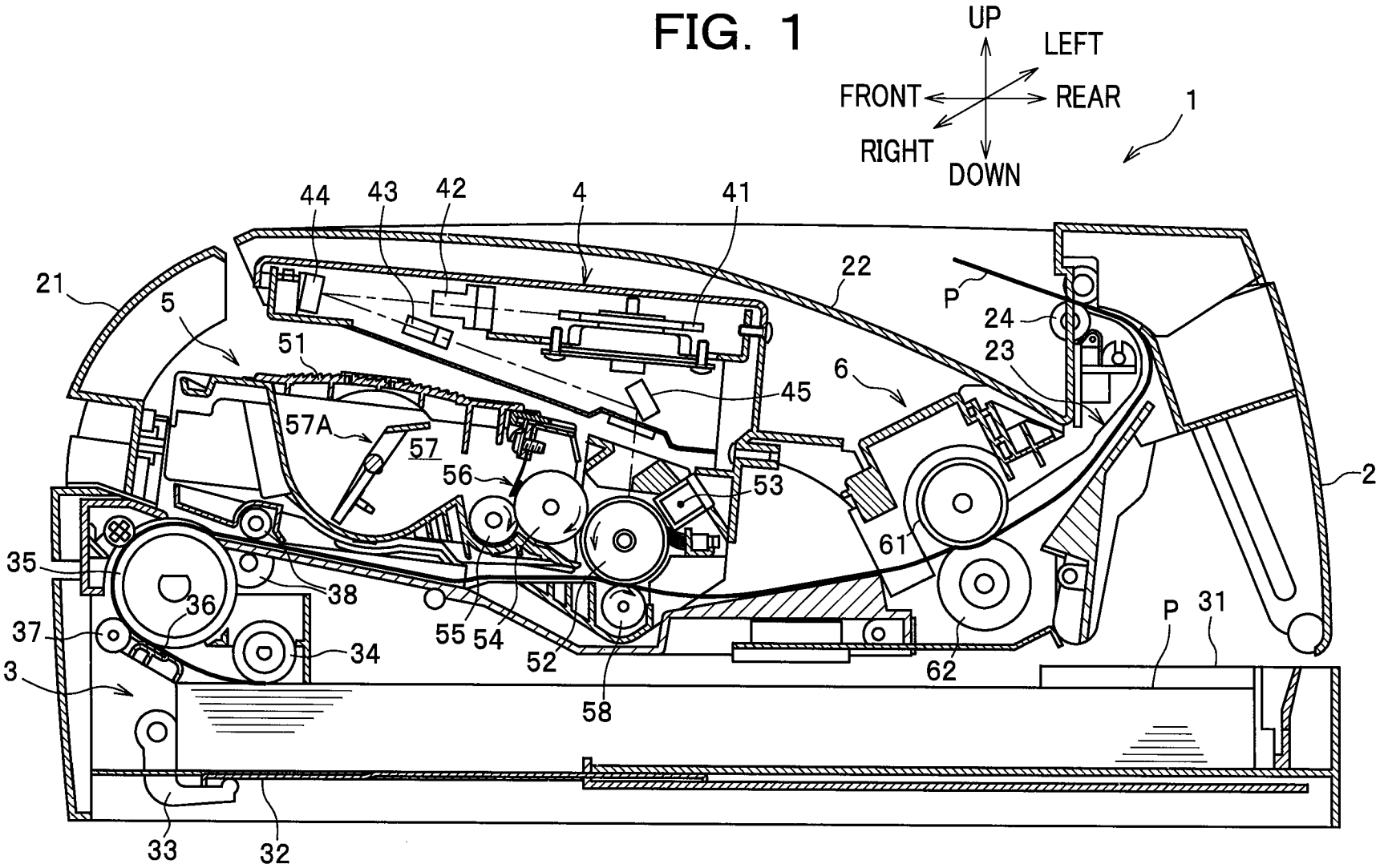
FIG. 1 is a vertical section of a laser printer as an example of an image-forming apparatus according to an exemplary embodiment of the present invention.

A detailed description will be given of exemplary embodiments of the present invention with reference to the drawings. In the following description, the direction is designated as from the viewpoint of a user who is using (operating) a laser printer (image-forming apparatus). To be more specific, in FIG. 1, the left-hand side of the drawing sheet corresponds to the "front" side of the printer, and the right-hand side of the drawing sheet corresponds to the "rear" side of the printer, the front side of the drawing sheet corresponds to the "right" side of the printer, and the back side of the drawing sheet corresponds to the "left" side of the printer. Similarly, the direction of a line extending from top to bottom of the drawing sheet corresponds to the "vertical" or "up/down (upper/lower or top/bottom)" direction of the printer.

General Setup of Laser Printer

At the outset, a general setup of a laser printer as an example of an image-forming apparatus according to an exemplary embodiment of the present invention will be described with reference to FIG. 1.

As shown in FIG. 1, a laser printer 1 comprises a body casing 2, and other components housed within the body casing 2 which principally include a sheet feeder unit 3 for feeding a sheet P (e.g., of paper) as a recording sheet, an exposure device 4, a process cartridge 5 for transferring a toner image (developer image) onto a sheet P, and a fixing device 6 for thermally fixing the toner image transferred onto the sheet P. At a front side of the body casing 2, an openable front cover 21 is provided such that the process cartridge 5 is removably installed inside the body casing 2 through an opening formed when the front cover 21 is opened. At an upper side of the body casing 2, a sheet output tray 22 is provided on which sheets P ejected out of the body casing 2 are stacked and accumulated.

The sheet feeder unit 3 is provided in a lower space within the body casing 2, and includes a sheet feed tray 31, a sheet pressure plate 32, and a lift lever 33. The sheet feed tray 31 is removably installed in the body casing 2. The sheet pressure plate 32 is provided at a bottom of the sheet feed tray 31 and configured to be tiltable (swingable on a pivot) so as to allow its front side (i.e., of the sheet feed tray 31) to be lifted up. The lift lever 33 is configured to lift the sheet pressure plate 32 up from its bottom side. The sheet feeder unit 3 also includes a pickup roller 34, a sheet feed roller 35, a sheet feed pad 36, a pinch roller 37, and a registration roller 38, all of which are disposed above a front side of the sheet feed tray 31 and configured to pick up and feed a sheet P from the sheet feed tray 31 into the process cartridge 5.

Sheets P in the sheet feed tray 31 are lifted by the lift lever 33 and the sheet pressure plate 32 and moved to a pickup roller 34 side, and picked up by the pickup roller 34. The sheets P thus picked up by the pick up roller 34 are separated and fed one after another by the sheet feed roller 35 and the sheet feed pad 36; each sheet P passes the pinch roller 37 and the registration roller 38 and is thus conveyed to the process cartridge 5.

The exposure device 4 is provided in an upper space within the body casing 2, and includes a laser beam emitter (not shown), a polygon mirror 41 configured to be driven to spin, lenses 42, 43, reflecting mirrors 44, 45 and other components. A laser beam formed in accordance with image data and emitted from the laser beam emitter is transmitted or reflected by the polygon mirror 41, lens 42, reflecting mirror 44, lens 43, and reflecting mirror 45 in this sequence as indicated by alternate long and short dashed lines, so as to scan a peripheral surface of a photoconductor drum 52 in the process cartridge 52 at high speed.

The process cartridge 5 is disposed below the exposure device 4, and removably installed in the body casing 2. The process cartridge 5 comprises a hollow casing 51 making up the outer frame of the process cartridge 5, and other components housed within the casing 51 which principally include a photoconductor drum 52, a charger 53, a development roller 54, a supply roller 55, a doctor blade 56, a toner reservoir 57, and a transfer roller 58.

In the process cartridge 5, the photoconductive surface of the photoconductor drum 52 is positively charged uniformly by the charger 53, and then exposed to a rapidly scanning laser beam from the exposure device 4. This exposure process lowers the potential of an exposed area(s) on the photoconductive surface, thus forming an electrostatic latent image thereon based upon the image data.

In the meantime, toner (now shown) in the toner reservoir 57 is supplied to the supply roller 55 by the action of a rotating agitator 57A, and then supplied onto the development roller 54 as the supply roller 55 and the development roller 54 slidably in contact with each other rotate. The toner supplied onto the development roller 54 goes between the doctor blade 56 and the development roller 54 as the development roller 54 rotates, to form a thin film of a predetermined thickness, so that the thin film of toner is retained on the development roller 54.

The toner retained on the development roller 54 is supplied onto the photoconductor drum 52 and transferred to the areas corresponding to the electrostatic latent image formed thereon, as the development roller 54 and the photoconductor drum 52 disposed opposite to each other rotate so that the toner-carrying areas on the development roller 54 come in contact with the photoconductor drum 52. The toner retained selectively, i.e., solely in the areas corresponding to the electrostatic latent image, thus visualizes the latent image, to form a toner image on the photoconductor drum 52. As a sheet P is held and fed forward between the photoconductor drum 52 and the transfer roller 58, the toner image on the photoconductor drum 52 is transferred to the sheet P.

The fixing device 6 is provided at a rear side of the process cartridge 5 (downstream relative to the process cartridge 5 in a sheet conveyance direction), and principally includes a heating roller 61 as one example of a heating element, and a pressure roller 62 as one example of a pressure element. The pressure roller 62 is disposed opposite to the heating roller 61, and a sheet P is pinched between the heating roller 61 and the pressure roller 62. The structure of the fixing device 6 will be described later in more detail.

The toner image transferred on a sheet P is thermally fixed while the sheet P passes through between the heating roller 61 and the pressure roller 62. The sheet P on which a toner image is thermally fixed is conveyed from the fixing device 6 into a sheet output path 23, and ejected from the sheet output path 23 out of the body casing 2 by a sheet output roller 24, so that sheets P are stacked and accumulated on the sheet output tray 22.

Detailed Structure of Fixing Device

Referring now to FIGS. 2 through 5, a detailed structure of the fixing device 6 will now be described.

Figure 2:
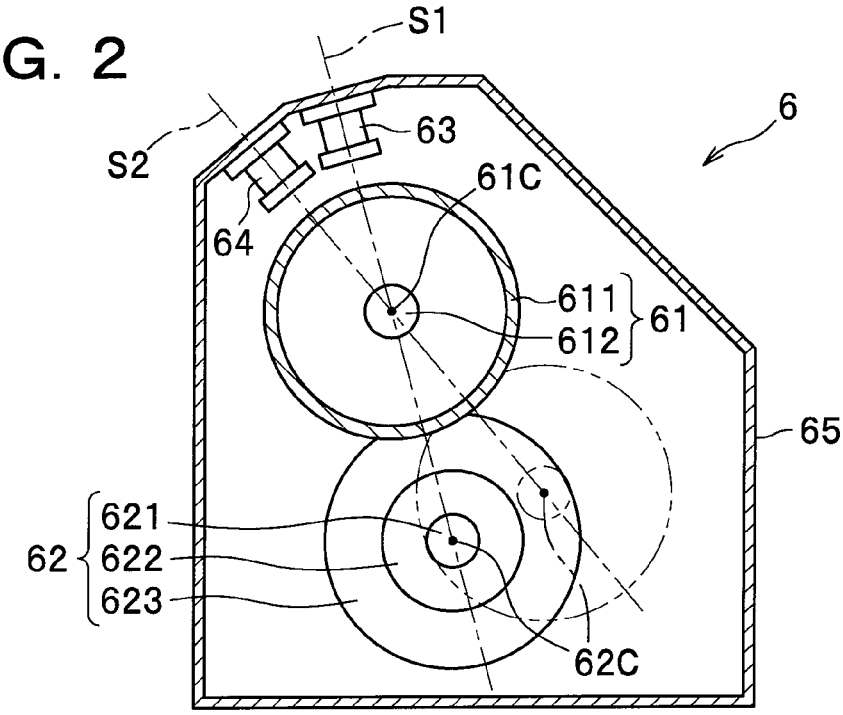
FIG. 2 is a schematic vertical section of a fixing device of FIG. 1, as viewed from a side thereof.

As shown in FIG. 2, the fixing device 6 principally includes a heating roller 61, a pressure roller 62, thermostats 63, 64 as an example of a plurality of interrupter elements, and a frame 65 which supports the heating roller 61, pressure roller 62 and thermostats 63, 64.

Figure 3:
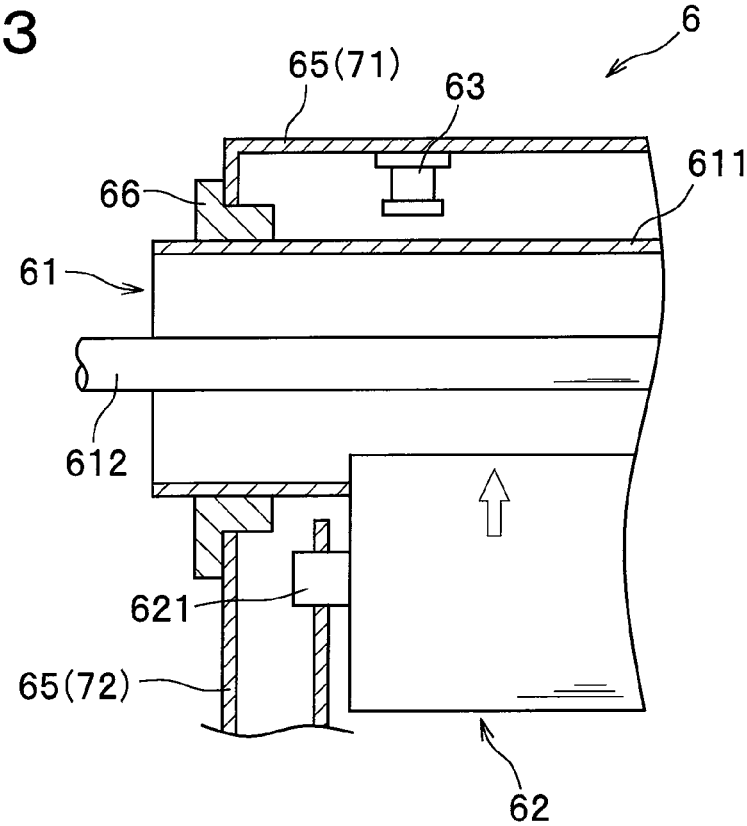
FIG. 3 is a partial vertical section of the fixing device of FIG. 2, as viewed from a rear thereof.

The heating roller 61 principally includes a cylindrical rotary body 611 made of metal and a halogen heater 612 as an example of a heat source which is disposed at the center 61C of rotation of the rotary body 611. The halogen heater 612 produces heat, by which the surface (outer peripheral surface) of the rotary body 611 is heated until it reaches a fixing temperature. As shown in FIG. 3, the heating roller 61 (rotary body 611) is rotatably supported by the frame 65 (upper frame 71); to be more specific, the heating roller 61 is supported at two ends thereof on bushings 66 fixed to the frame 65. The bushings 66 are made of thermoplastic resin which will melt (or soften and deform) when the surface temperature of the heating roller 61 (rotary body 611) increases beyond the fixing temperature (when the temperature is not lower than a predetermined threshold value).

As shown in FIG. 2, the pressure roller 62 is principally composed of a shaft 621, a metal core 622 provided around the shaft 621, and an elastic layer 623 which covers the metal core 622, and the shaft 621 is rotatably supported by the frame 65 (lower frame 72), as shown in FIG. 3. The pressure roller 62 is configured to be movable so as to be positioned selectively in a first pressing position indicated by solid lines in FIG. 2 and a second pressing position indicated by chain double-dashed lines in FIG. 2, and the pressure roller 62 in each pressing position is configured to be pressed against the heating roller 61. The mechanism which causes the pressure roller 62 to be positioned in either of the pressing positions and pressed against the heating roller 61 will be described later.

The thermostats 63, 64 are known parts, for example, each made of a bimetal strip (not shown), and configured to interrupt a flow of electrical current when a temperature it senses is not lower than a predetermined threshold value. The thermostats 63, 64 in the present embodiment are those of a particular type which will not restore the flow of electrical current without a manual intervention.

The thermostats 63, 64 are provided in positions corresponding to the first and second pressing positions of the pressure roller 62, respectively, and disposed above and opposite to the heating roller 61. To be more specific, the thermostat 63 is disposed behind the heating roller 61 when viewed from the pressure roller 62 disposed in the first pressing position indicated by the solid lines in FIG. 2, and in a plane S1 containing an axis 61C of rotation of the heating roller 61 and an axis 62C of rotation of the pressure roller 62 disposed in the first pressing position. On the other hand, the thermostat 64 is disposed behind the heating roller 61 when viewed from the pressure roller 62 disposed in the second pressing position indicated by the chain double-dashed lines in FIG. 2, and in a plane S2 containing the axis 61C of rotation of the heating roller 61 and the axis 62C of rotation of the pressure roller 62 disposed in the second pressing position.

Moreover, the thermostats 63, 64 in the present embodiment are disposed in the positions aligned in an axial direction of the heating roller 61 (lateral direction in FIG. 3), i.e., in one plane perpendicular to the axis 61C of rotation of the heating roller 61. That is, the thermostats 63, 64 are disposed so as to overlap each other when viewed from rearward (or frontward) as shown in FIG. 3 (in which thermostat 64 is hidden behind thermostat 63 and thus not illustrated).

The thermostats 63, 64 are disposed such that the distances therefrom to the surface (outer peripheral surface) of the heating roller 61 are equal to each other.

Figure 4:
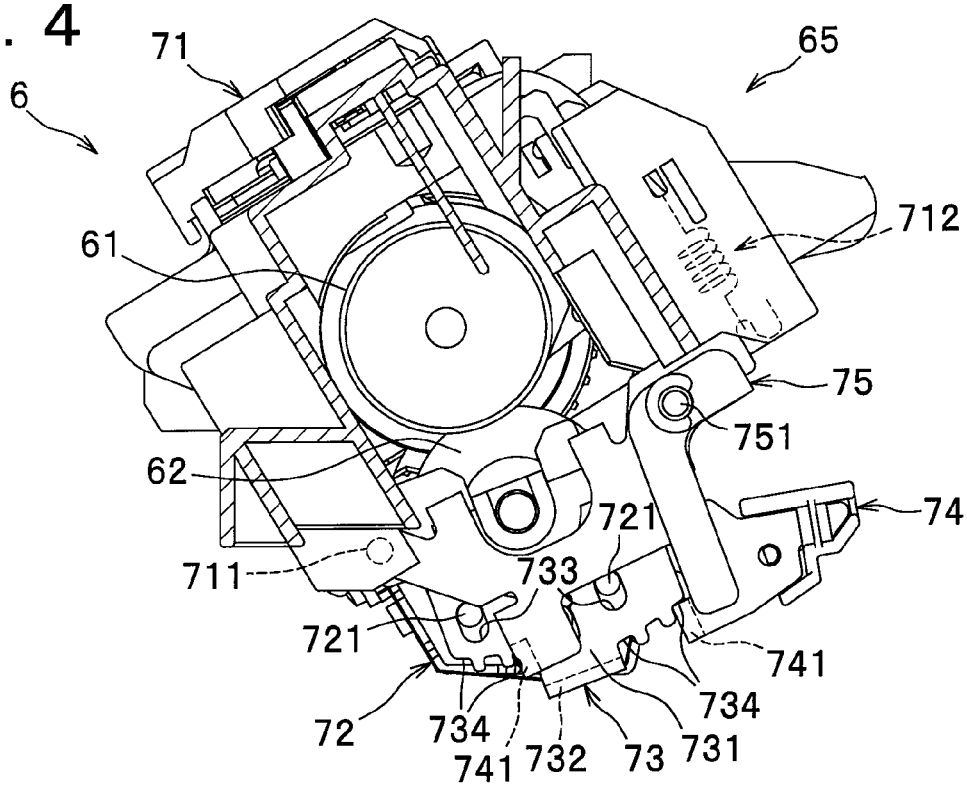
FIG. 4 is a side view of the fixing device in which a pressure roller is disposed in a first pressing position.

As shown in FIG. 4, the frame 65 principally includes an upper frame 71, a lower frame 72, a locating member 73, a pressing member 74, and a releasing member 75.

The upper frame 71 is a member by which the heating roller 61 is rotatably supported. The upper frame 71 has right and left sidewalls disposed opposite to each other. The pressing member 74 that will be described later is rotatably supported by pressing member support portions 711 provided at front lower portions of the sidewalls. Two extension springs 712 are provided between the upper frame 71 and the pressing member 74 at right and left sides of the frame 65. One end of each extension spring 712 is attached to a rear portion of each sidewall of the upper frame 71, and the other end of the extension spring 712 is attached to a rear end portion of the pressing member 74.

The lower frame 72 is a member by which the pressure roller 62 is rotatably supported. The lower frame 72 is movable relative to the upper fame 71 in a circumferential direction of the heating roller 61. The lower frame 72 has right and left sidewalls disposed opposite to each other. The locating member 73 that will be described later is slidably supported by a plurality of projections 721, 722 (see FIG. 7) which are provided at the sidewalls of the lower frame 72 and protrude outwardly in an axial direction of the pressure roller 62.

The locating member 73 comprises two substantially L-shaped portions provided at right and left sides of the frame 65. Each L-shaped portion of the locating member 73 is composed principally of a main body 731 and an operation tab 732. The main body 731 is disposed opposite to a corresponding sidewall of the lower frame 72 from an outside thereof in the axial direction of the pressure roller 62. The operation tab 732 extends from a midsection of a lower end of the main body 731 inwardly in the axial direction of the pressure roller 62.

Figure 8:
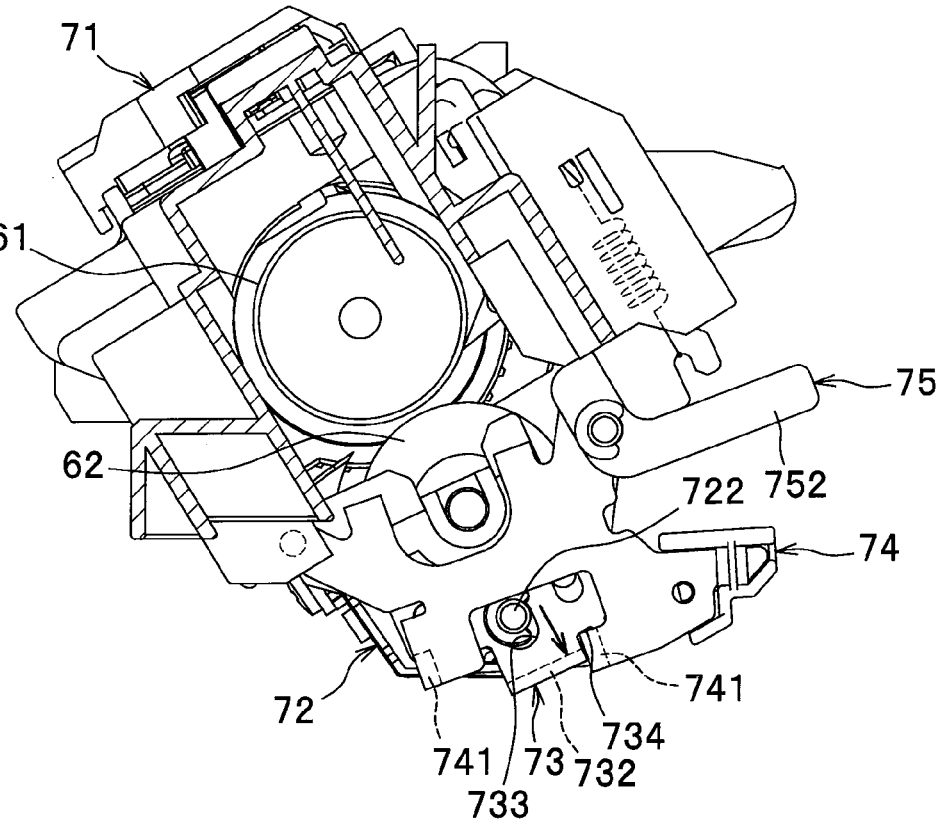
FIG. 8 is a side view of the fixing device in which the pressure roller is retained in the second release position.

The main body 731 of the locating member 73 has a slot 733 disposed in a position corresponding to a position of the projection 721 or 722 provided in the lower frame 72 (see FIG. 8). The slot 733 is a narrow opening elongated in an opposing direction in which the heating roller 61 and the pressure roller 62 are opposed to each other (i.e., the direction of a line extending between the centers of rotation of the rollers 61 and 62 as viewed from the axial direction of the rollers 61, 62). Each of the projections 721, 722 is disposed inside the slot 733 of the corresponding main body 731. With this construction, the locating member 73 is slidable relative to the lower frame 72 in the opposing direction of the heating roller 61 and the pressure roller 62.

The lower end, other than the midsection where the operation tab 732 is provided, of each main body 731 (i.e., front and rear sections extending frontward and rearward from the front and rear edges of the operation tab 732) is substantially in the form of a segment of a circle of which a center of curvature coincides with the center of rotation of the heating roller 61, and locating notches 734 are provided therein.

The locating member 73 is always pushed substantially in a downward direction by a leaf spring (not shown) fixed to the lower frame 72. Thus, when the operation tab 732 is manipulated and pressed substantially in an upward direction (toward the pressure roller 62) under action of the opposing force of the leaf spring, the locating member 73 is slid upward.

The pressing member 74 comprises two side portions each of which is disposed opposite to a corresponding sidewall of the lower frame 72 or the locating member 73 corresponding thereto from an outside thereof in the axial direction of the pressure roller 62. The pressing member 74 is configured, as described above, such that the pressing member 74 is rotatably supported at its front end portions by the pressing member support portions 711 of the upper frame 71 and the other end of each of the extension springs 712 is attached to the rear end portion of the pressing member 74. Accordingly, the pressing member 74 (the rear end thereof) can be swung in a direction toward or away from the upper frame 71, and is pushed (urged) in the direction toward the upper frame 71 by the action of the extension spring 712.

Each side portion of the pressing member 74 has two downward extending sections (designation by reference numerals is omitted in the drawings). At a front end of each downward extending section, an engageable piece 741 is provided which extends inwardly in the axial direction of the pressure roller 62. The engageable piece 741 is designed to engage in any one of the locating notches 434 when the locating member 73 is being pushed substantially in the downward direction by the leaf spring. With this configuration, the movement of the lower frame 72 relative to the upper frame 71 in the circumferential direction of the heating roller 61 is restricted by the locating member 73, so that the position of the pressure roller 62 supported by the lower frame 72 is fixed.

When the engageable piece 741 engages in one of the locating notches 734, the engageable piece 741 comes in contact with a lower end of the sidewall of the lower frame 72 by the action of the extension spring 712, and pushes the lower frame 72 toward the upper frame 71. In this way, the pressure roller 62 supported by the lower frame 72 is pressed toward the heating roller 61 supported by the upper frame 71.

The releasing member 75 is shaped substantially like a letter L as viewed from a side thereof (i.e., as viewed in the axial direction of the pressure roller 62), and pivotably attached to the rear end of each side portion of the pressing member 74 by a pivot shaft 751. In the state illustrated in FIG. 4, there is a predetermined gap between the releasing member 75 and the upper frame 71, and thus the pressure roller 62 is being pressed toward the heating roller 61 through the pressing member 74 and the lower frame 72 by the action of the extension spring 712.

Figure 5:
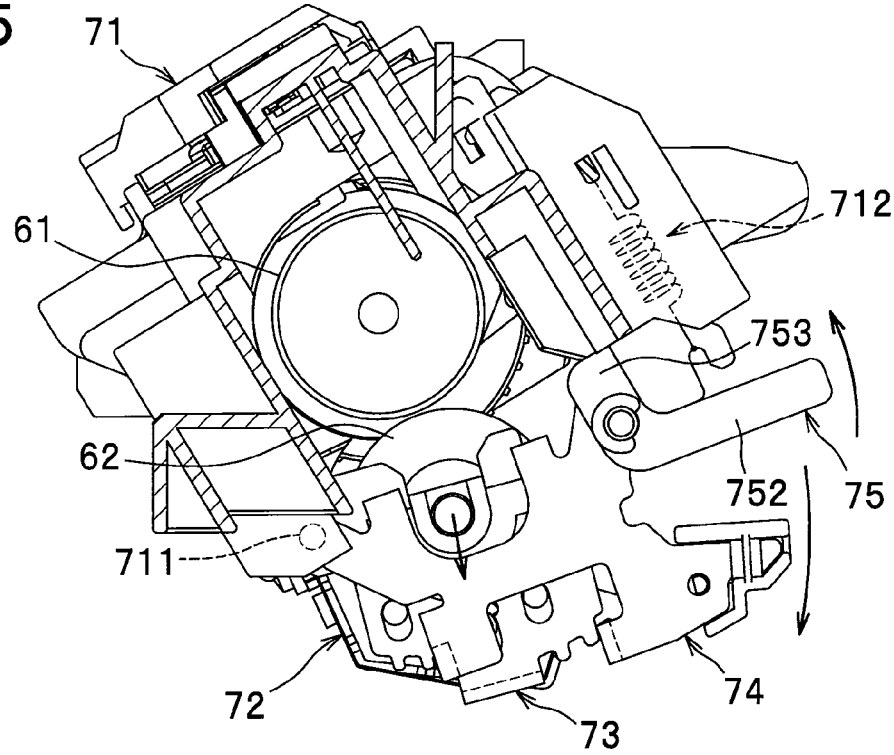
FIG. 5 is a side view of the fixing device in which the pressure roller is not pressed against a heating roller and released from the first pressing position.

As shown in FIG. 5, when an operation lever 752 of the releasing member 75 is pivoted rearward, an end block 753 of the releasing member 75 is caused to abut on the upper frame 71, and the pressing member 74 (the rear end thereof) is pushed down under the action of the opposing elastic force of the extension spring 712. In this way, the pressure roller 62 is separated from the heating roller 61, and the pressing force on the pressure roller 62 is released.

Figure 6:
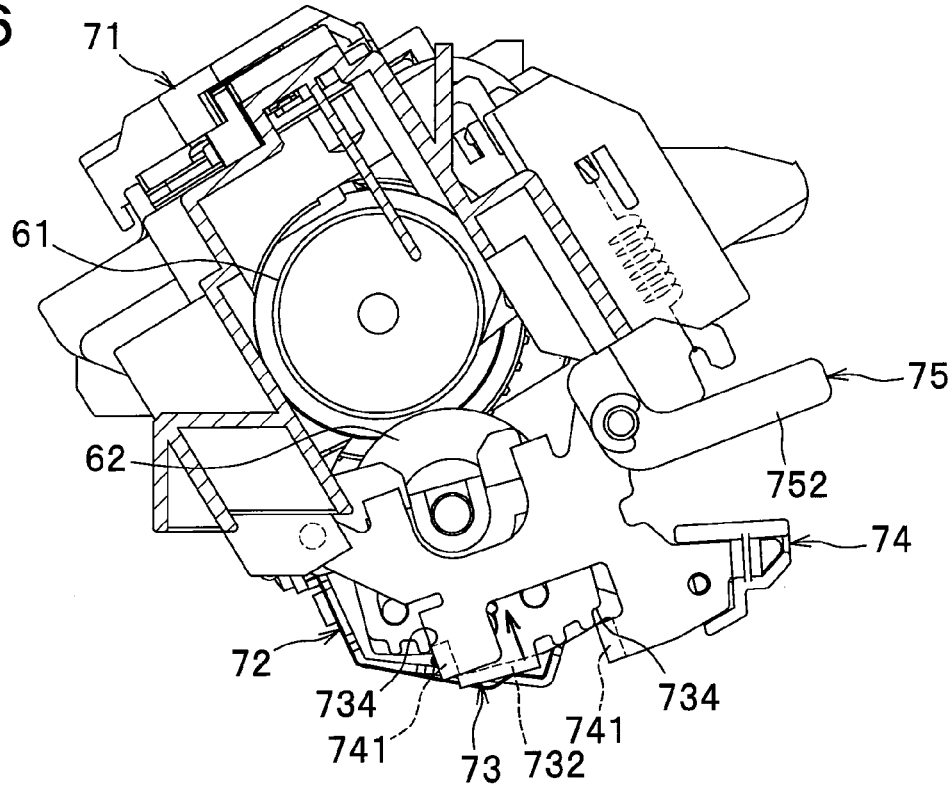
FIG. 6 is a side view of the fixing device in which the pressure roller is ready to be moved from a first release position to a second release position.
Figure 7:
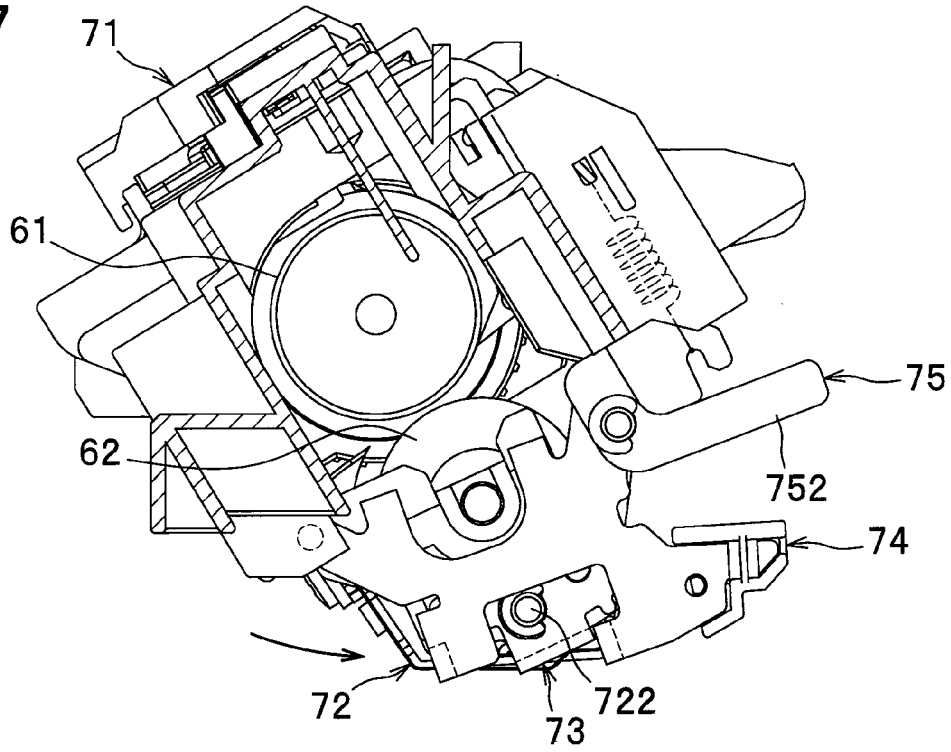
FIG. 7 is a side view of the fixing device in which the pressure roller has been moved from the first release position to the second release position.
Figure 9:
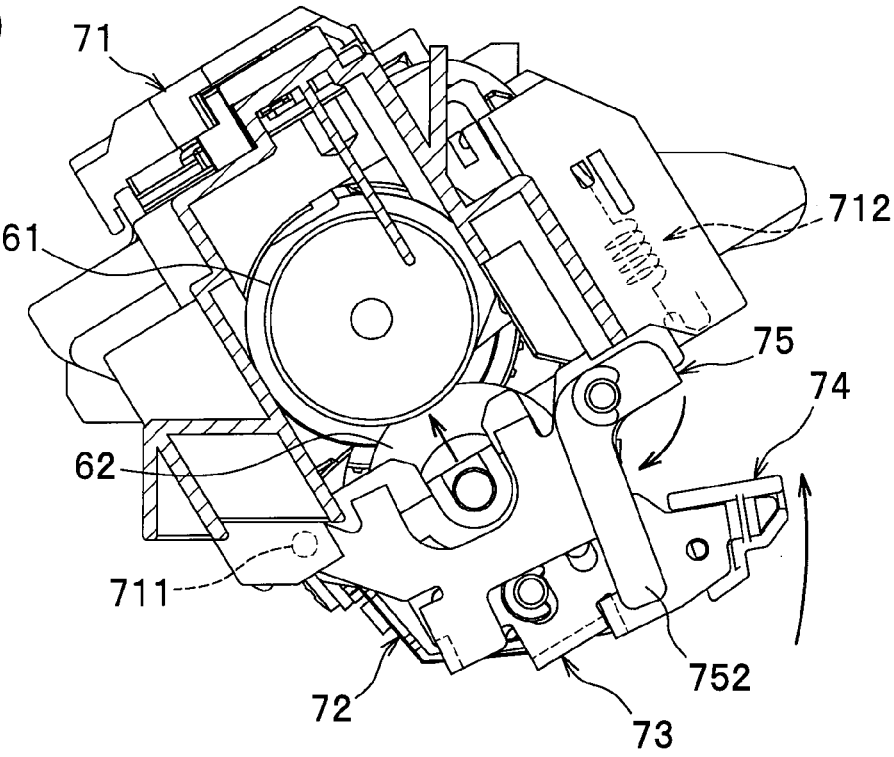
FIG. 9 is a side view of the fixing device in which the pressure roller is disposed in a second pressing position.

The operation (motion of the frame 65) performed when the pressure roller 62 is moved from the first pressing position to the second pressing position will be described hereafter. For convenience of explanation, some positions of the pressure roller 62 are designated as follows: a position that is shifted from the first pressing position as a result of release of the pressing force on the pressure roller 62 is referred to as "first release position"; and a position that is shifted from the second pressing position as a result of release of the pressing force on the pressure roller 62 is referred to as "second release position". FIG. 6 shows the state of the pressure roller 62 released and allowed to move from the first release position to the second release position, FIG. 7 shows the state of the pressure roller 62 moved from the first release position to the second release position, FIG. 8 shows the state of the pressure roller 62 retained in the second release position, and FIG. 9 shows the state of the pressure roller 62 disposed in the second pressing position.

First, as shown in FIG. 5, the operation lever 752 of the releasing member 75 is pivoted rearward. Then the pressure roller 62 is released from the pressing force, and moves to the first release position.

Next, as shown in FIG. 6, the operation tab 732 of the locating member 73 is pressed substantially in the upward direction (toward the pressure roller 62) under action of the opposing force of the leaf spring. Then the locating member 73 slides upward, and the engagement of the engageable piece 741 of the pressing member 74 in the locating notch 734 is released.

Accordingly, the lower frame 72 is allowed to move relative to the upper frame 71 in the circumferential direction of the heating roller 61. Thus, as shown in FIG. 7, when the lower frame 72 is moved rearward, the pressure roller 62 is moved from the first release position to the second release position.

Thereafter, as shown in FIG. 8, when the pressing force on the operation tab 732 is released, the locating member 73 moves substantially in the downward direction, and thus the engageable piece 741 of the pressing member 74 engages in the locating notch 734. In this way, the movement of the lower frame 72 relative to the upper frame 71 in the circumferential direction of the heating roller 61 is restricted by the locating member 73, with the result that the pressure roller 62 supported by the lower frame 72 is retained in the second release position.

Next, as shown in FIG. 9, when the operation lever 752 of the releasing member 75 is pivoted frontward, the lower frame 72 is moved toward the upper frame 71 by the pressing member 74 by the action of the extension spring 712. In this way the pressure roller 62 is moved to the second pressing position in which the pressure roller 62 is pressed against the heating roller 61.

In order that the pressure roller 62 should be moved from the second pressing position to the first pressing position, the process steps of the operation described above is reversely performed.

Advantages of the fixing device 6 configured as described above according to the present embodiment will be described with reference to FIG. 10 in which the state of the fixing device whose heating roller 61 has a surface temperature higher than a fixing temperature is illustrated.

Figure 10:
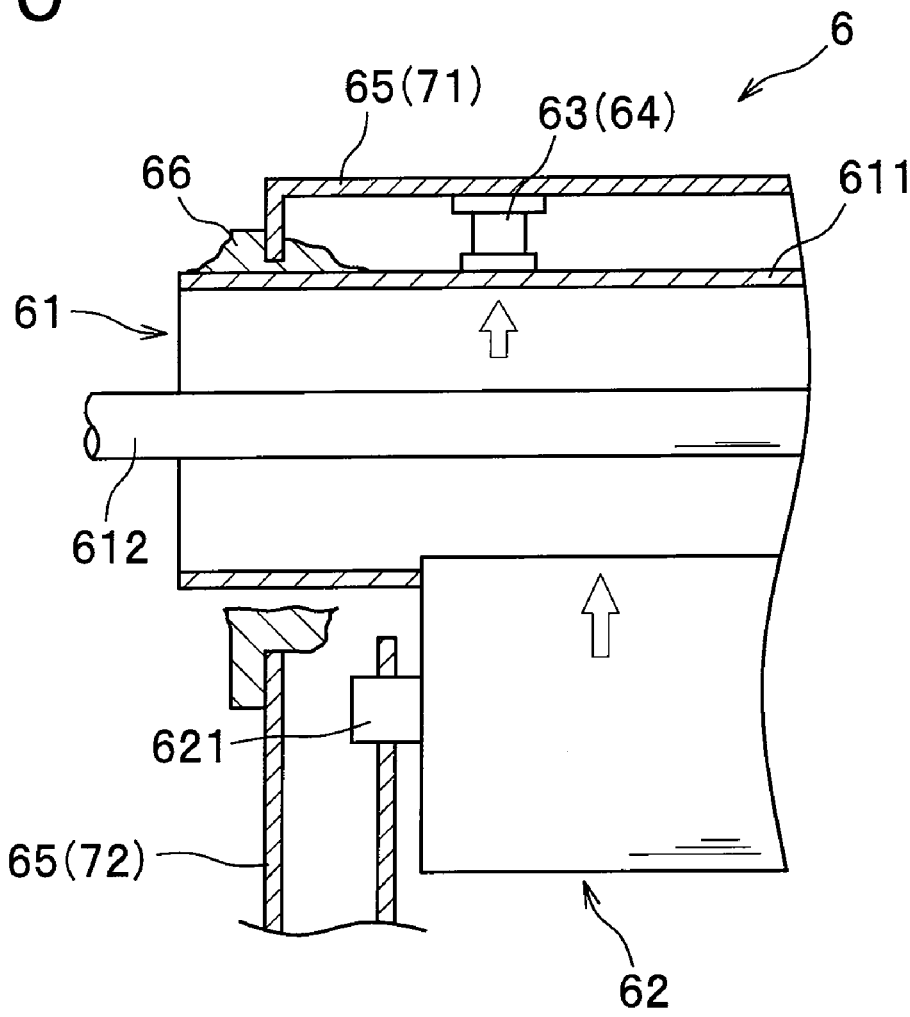
FIG. 10 is a partial vertical section of the fixing device as viewed from the rear, for illustrating the state in which a surface temperature of a heating roller is higher than a fixing temperature.

As shown in FIG. 10, when the pressure roller 62 is in the first pressing position, an increase in the surface temperature of the heating roller 61 (rotary body 611) substantially beyond the fixing temperature (i.e., which means that it turns out the temperature is not lower than a predetermined threshold value) causes the bushings 66 made of plastic resin and supporting the heating roller 61 to melt (or soften and become readily deformable). As a result, the bushings 66 become unable to withstand the pressing force of the pressure roller 62, and thus the heating roller 61 moves in the direction of the pressing force by the pressing force of the pressure roller 62.

In this fixing device 6, the thermostat 63 is disposed across the heating roller 61 from the pressure roller 62 in a plane S1 containing the axis 61C of rotation of the heating roller 61 and the axis 62C of rotation of the pressure roller 62 disposed in the first pressing position. Therefore, the heating roller 61 moving in the direction of the pressing force comes in proximity to (or in contact with, as the case may be) the thermostat 63.

When the pressure roller 62 is in the second pressing position, similarly, an increase in the surface temperature of the heating roller 62 substantially beyond the fixing temperature causes the bushings 66 to melt, and thus the heating roller 61 moves in the direction of the pressing force by the pressing force of the pressure roller 62. In the fixing device 6, the thermostat 64 is disposed across the heating roller 61 from the pressure roller 62 in a plane S2 containing the axis 61C of rotation of the heating roller 61 and the axis 62C of rotation of the pressure roller 62 disposed in the second pressing position. Therefore, the heating roller 61 moving in the direction of the pressing force comes in proximity to the thermostat 64.

In this way, the temperature sensed by the thermostat 63 (or 64) increases more rapidly and becomes a value not lower than the predetermined threshold value more swiftly than that which is sensed when the heating roller 61 is remote from the thermostat 63 (or 64) as shown in FIG. 3. Accordingly, the flow of electrical current to the halogen heater 612 is interrupted swiftly (i.e., always at an early stage in a timely fashion), and thus the increase in the temperature of the heating roller 61 can be stopped swiftly (i.e., without delay).

In the fixing device 6 according to the present embodiment, the thermostats 63, 64 are provided in positions corresponding to the pressing positions, respectively, so that irrespective of the pressing position in which the pressure roller 62 adjustable in position is currently located, the corresponding thermostat 63 or 64 senses the temperature of the heating roller 61 under the invariable conditions. Thus, the flow of electrical current to the halogen heater 612 can be interrupted under the same conditions which do not vary according to the pressing position of a pressure roller 62.

Moreover, since each of the thermostats 63, 64 is disposed in a respective plane S1, S2 containing the axis 61C of rotation of the heating roller 61 and the axis 62C of rotation of the pressure roller 62 disposed in the corresponding pressing position, the heating roller 61 pushed by the pressure roller 62 can be brought into proximity to (or contact with) the thermostat 63 or 64 at the shortest distance from the heating roller 61. As a result, the flow of electrical current to the halogen heater 612 can be interrupted swiftly (i.e., always timely at an early stage), and the increase in the temperature of the heating roller 61 can be stopped (i.e., without delay).

Furthermore, since the two thermostats 63, 64 are disposed in one and the same plane perpendicular to the axis 61C of rotation of the heating roller 61, the conditions under which the temperature of the heating roller 61 is sensed can always be maintained more consistently.

Although one exemplary embodiment of the present invention has been described above, the present invention is not limited to the above-described embodiment. It is to be understood that various modifications and changes may be made to the specific configurations without departing the scope of the present invention where appropriate.

Figure 11A:
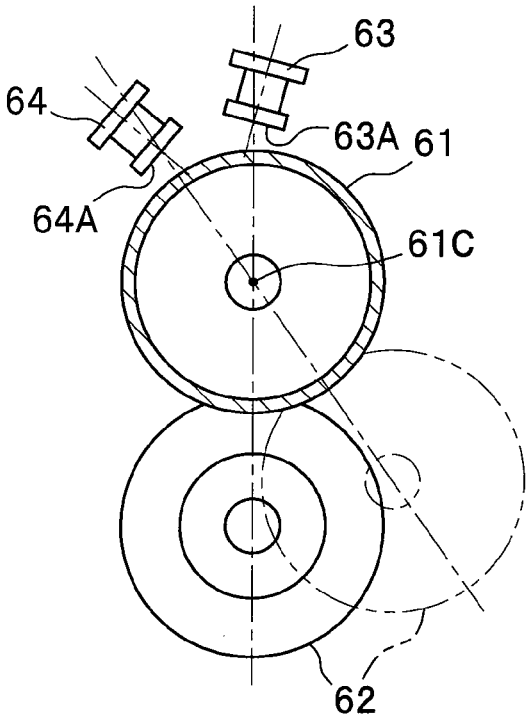
FIGS. 11A, 11B and 11C are schematic vertical sections of a fixing device, according to a modified embodiment of the present invention, in which a sensing face of each thermostat is tilted.

In the above-described embodiment, the illustrated thermostats 63, 64 are disposed such that sensing faces (not designated by reference numerals in FIG. 2) thereof are substantially perpendicular to the planes S1, S2, but the present invention is not limited to this particular arrangement. For example, as shown in FIG. 11A, the thermostats 63, 64 may be disposed such that the sensing faces 63A, 64A adapted to sense the temperature of the heating roller 61 are tilted away from the axis 61C of rotation of the heating roller 61 toward the adjacent thermostats 64, 63. With this modification, the following advantageous effects can be expected.

Figure 11B:
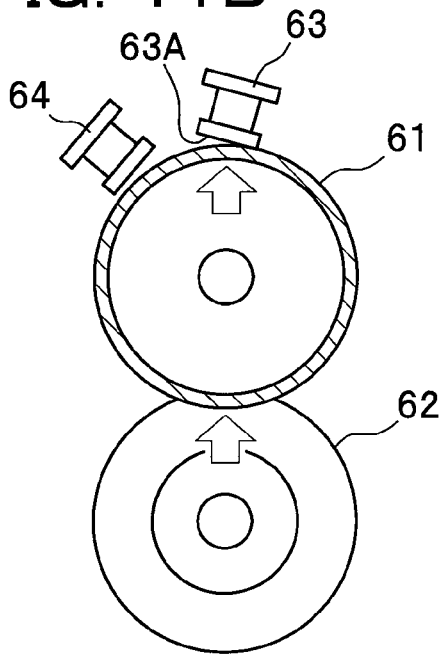
Figure 11C:
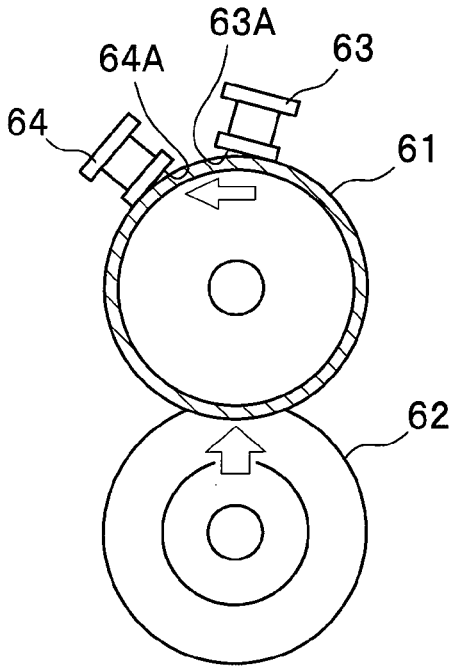

Assume, for example, that the surface temperature of the heating roller 61 increases beyond the fixing temperature and the bushings (not shown) melt, so that the heating roller 61 pressed by the pressure roller 62 comes in contact with the sensing face 63A of the thermostat 63, as shown in FIG. 11B. In this situation, the heating roller 61 pressed by the pressure roller 62 further moves to be fitted between the sensing face 63A and the sensing face 64A, as shown in FIG. 11C, and thus also comes in contact with the sensing face 64A of the thermostat 64 adjacent to the thermostat 63.

A similar phenomenon may be observed with the above-described embodiment, but the heating roller 61 can be brought into contact with the sensing face 64A of the thermostat 64 more swiftly according to this modified embodiment because the sensing faces 63A, 64A are tilted. Consequently, even if the thermostat 63 fails to sense the increase in temperature, the thermostat 64 can sense the increase in temperature swiftly, so that the flow of electrical current to the heat source can be interrupted swiftly without fail.

Figure 12:
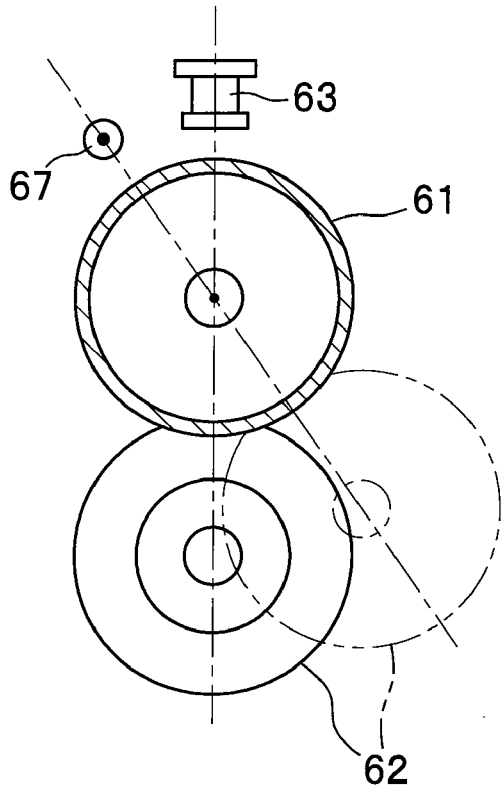
FIG. 12 is a schematic vertical section of a fixing device, according to another modified embodiment of the present invention, in which a thermostat and a thermal fuse are used in combination.

In the above-described embodiment, the thermostats 63, 64 are adopted as an example of a plurality of interrupter elements, but interrupter elements usable in the present invention are not limited to this specific example. For example, a thermal fuse may be adopted which melts to interrupt a flow of electrical current to a heat source when the temperature is not lower than a predetermined threshold value. Furthermore, the plurality of interrupter elements comprising two thermostats 63, 64 are illustrated in the above-described embodiment, but the present invention is not limited to this particular combination. For example, as shown in FIG. 12, a thermostat 63 and a thermal fuse 67 may be used in combination. In this modified embodiment, the thermostat 63 quick in response may be disposed in a position corresponding to a default pressing position, and the thermal fuse 67 may be disposed in another position corresponding to the other pressing position. In general, the thermal fuse is a cost-effective element, the combined use of at least one thermal fuse and at least one thermostat may be preferable because the use of thermal fuse instead of thermostat contributes to cost reduction of the fixing device.

In the above-described embodiment, the two thermostats 63, 64 (as a plurality of interrupter elements) are disposed in one plane perpendicular to the axis 61C of rotation of the heating roller 61, but the present invention is not limited to this particular arrangement. For example, some of a plurality of interrupter elements may be disposed in different positions shifted in the axial direction of the heating roller as long as the positions are such that the temperature of the pressure element in each of the pressing positions can be sensed by any of the interrupter elements.

In the above-described embodiment, the pressure roller 62 is configured to be positioned selectively in two pressing positions, but the present invention is not limited to this particular configuration. For example, the pressure roller (pressure element) may be configured to be positioned selectively in more than two pressing positions.

In this modified embodiment where the pressure roller is configured to be positioned selectively in three or more pressing positions, an interrupter element which is to be disposed in a position opposite to and across the heating roller from the pressure roller does not have to be provided in each of the positions corresponding to the pressing positions of the pressure roller (i.e., the number of interrupter elements is not necessarily equal to the number of the pressing positions). In other words, the plurality of interrupter elements consistent with the present invention are disposed in positions such that at least one of the interrupter elements is capable of sensing the temperature of the heating element pressed by the pressure element disposed in each of the pressing positions.

Figure 13:
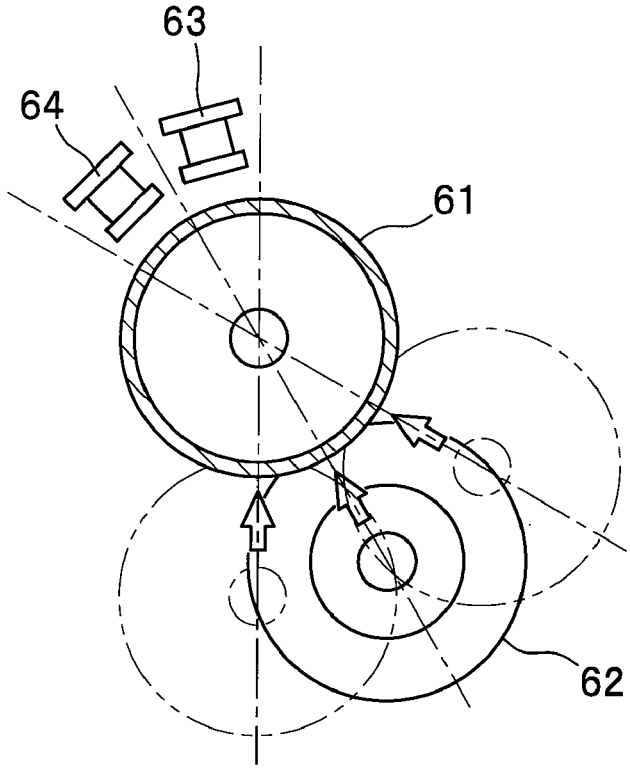
FIG. 13 is a schematic vertical section of a fixing device, according to yet another modified embodiment of the present invention, in which a pressure roller can be positioned in any of three pressing positions.

Assuming, for example, that the pressure roller 62 is configured to be positioned selectively in three pressing positions as shown in FIG. 13, one interrupter element (thermostat 63 or 64) may be disposed in each space defined between a direction (indicated by an arrow and alternate long and short dashed lines) in which the pressure roller 62 in one pressing position (indicated by the solid lines in FIG. 13) is configured to be pressed against the heating roller 61 and a direction in which the pressure roller 62 in another pressing position (indicated by chain double-dashed lines in FIG. 13) adjacent to the one pressing position is configured to be pressed against the heating roller 61. In this modified embodiment, In comparison with an alternative embodiment in which one interrupter element is disposed in each of the positions toward which a pressure element configured to be positioned selectively in three or more pressing positions is pressed against a heating element, the number of interrupter elements can be reduced, and thus the cost for the fixing device can be reduced.

In the above-described embodiment, one interrupter element is disposed each in a corresponding plane S1 or S2 containing the axis 61C of rotation of the heating roller 61 and the axis 62C of rotation of the pressure roller 62 disposed in each pressing position as shown in FIG. 2, but the present invention is not limited to this particular configuration. For example, two or more interrupter elements may be disposed each in a corresponding plane containing the axis 61C of rotation of the heating roller 61 and the axis 62C of rotation of the pressure roller 62 disposed in each pressing position. Moreover, two or more interrupter elements may be disposed in one plane containing the axis 61C of rotation of the heating roller 61 and the axis 62C of rotation of the pressure roller 62 disposed in one pressing position, while one interrupter element is disposed in another plane containing the axis 61C of rotation of the heating roller 61 and the axis 62C of rotation of the pressure roller 62 disposed in another pressing position.

In the above-described embodiment, the heating roller 61 is adopted as one example of a heating element, and the pressure roller 62 is adopted as one example of a pressure element, but the present invention is not limited to this particular configuration. For example, a film-like heating element may be employed as another example of the heating element, and a belt-like pressure element may be employed as another example of the pressure element.

In the above-described embodiment, the halogen heater 612 is adopted as one example of a heat source, but the heat source by which a heating element is heated is not limited thereto; for example, a ceramic heater may be employed, instead.

In the above-described embodiment, the fixing device 6 is used in the laser printer 1 as one example of an image-forming apparatus, but the image-forming apparatus in which a fixing device according to the present invention can be used is not limited thereto. For example, the fixing device according to the present invention may be used with an LED printer, a photocopier, or a multifunction peripheral of various types in which a color image can be formed.

What is claimed is:

1. A fixing device for fixing a developer image transferred onto a recording sheet, the fixing device comprising:

a heating element configured to be heated by a heat source;

a pressure element configured to be positioned selectively in two or more pressing positions defined relative to the heating element, wherein the pressure element in any one of the pressing positions is configured to be pressed against the heating element; and a plurality of interrupter elements provided opposite to the heating element, each of the interrupter elements being configured to sense a temperature of the heating element and to interrupt a flow of electrical current to the heat source when the temperature is not lower than a predetermined threshold value, wherein the interrupter elements are arranged in positions corresponding to the pressing positions.

2. The fixing device according to claim 1, wherein the heating element is embodied as a heating roller and the pressure element is embodied as a pressure roller, and wherein at least one of the interrupter elements is disposed in a plane containing an axis of rotation of the heating roller and an axis of rotation of the pressure roller disposed in each of the pressing positions.

3. The fixing device according to claim 2, wherein all the interrupter elements are disposed in one plane perpendicular to the axis of rotation of the heating roller.

4. The fixing device according to claim 2, wherein the interrupter elements each have a sensing face capable of sensing a temperature, and the sensing face of at least one of the interrupter elements is tilted away from the axis of rotation of the heating roller toward another interrupter element adjacent thereto.

5. The fixing device according to claim 3, wherein the interrupter elements each have a sensing face capable of sensing a temperature, and the sensing face of at least one of the interrupter elements is tilted away from the axis of rotation of the heating roller toward another interrupter element adjacent thereto.

6. The fixing device according to claim 1, wherein the plurality of interrupter elements comprise at least one thermostat and at least one thermal fuse.

7. The fixing device according to claim 1, wherein the pressure element is configured to be positioned selectively in at least three pressing positions defined relative to the heating element, and wherein at least one of the interrupter elements is disposed in each space defined between a direction in which the pressure element in one pressing position is configured to be pressed against the heating element and a direction in which the pressure element in another pressing position adjacent to the one pressing position is configured to be pressed against the heating element.

8. The fixing device according to claim 1, wherein the heating element is embodied as a heating roller and the pressure element is embodied as a pressure roller, wherein the pressure roller is configured to be positioned selectively in at least three pressing positions defined relative to the heating roller, and wherein at least one of the interrupter elements is disposed in each space defined between first and second planes, the first plane extending from an axis of rotation of the pressure roller disposed in one pressing position beyond an axis of rotation of the heating roller, and the second plane extending from the axis of rotation of the pressure roller disposed in another pressing position adjacent to the one pressing position beyond the axis of rotation of the heating roller.

9. The fixing device according to claim 1, wherein distances from the interrupter elements to a surface of the heating element are equal to each other.

* * * * *